US007030565B2

(12) United States Patent
Hollaway

(10) Patent No.: US 7,030,565 B2
(45) Date of Patent: Apr. 18, 2006

(54) LAMP CONTROL CIRCUIT WITH SELECTABLE COLOR SIGNALS

(76) Inventor: Jerrell Penn Hollaway, 3636 Woodstock Ct., Melbourne, FL (US) 32904

( * ) Notice: Subject to any disclaimer, the term of this patent is extended or adjusted under 35 U.S.C. 154(b) by 107 days.

(21) Appl. No.: 10/899,722

(22) Filed: Jul. 27, 2004

(65) Prior Publication Data

US 2006/0022599 A1 Feb. 2, 2006

(51) Int. Cl.
*H05B 37/00* (2006.01)

(52) U.S. Cl. ..... 315/200 A; 315/291; 315/307; 315/209 R; 315/312

(58) Field of Classification Search ..... None
See application file for complete search history.

(56) References Cited

U.S. PATENT DOCUMENTS 5,248,919 A * 9/1993 Hanna et al. ..... 315/291
5,272,418 A * 12/1993 Howe et al. ..... 315/159
5,670,846 A 9/1997 Hollaway ..... 315/151

* cited by examiner

*Primary Examiner*—Tuyet Thi Vo

(57) ABSTRACT

The present invention describes a control circuit to be used in a lamp adapter that gives the user the ability to flash the main bulb on and off and, at the same time, flash a colored LED to indicate the purpose of the main bulb flashing. A first brief power interruption from the main switch starts the main bulb flashing and energizes a LED of a first color. A second interruption continues the flashing and energizes a LED of a second color. The intended purpose of the invention is be draw attention to a home and indicate whether or not an emergency exists.

9 Claims, 1 Drawing Sheet

LAMP CONTROL CIRCUIT WITH SELECTABLE COLOR SIGNALS

BACKGROUND OF THE INVENTION

1. Field of Invention

The present invention relates to lamp adapters used to change the appearance of light from regular lamp fixtures for the purpose of attracting attention. This invention causes the main bulb in a lamp fixture to flash on and off and, at the same time, causes a multi-color LED to exhibit a color that corresponds to the user's need.

2. Description of Related Art

Lamp adapters and control circuits have been developed by this inventor and others for changing the appearance of the light from a regular light bulb. Most significantly, the invention described in U.S. Pat. No. 5,670,846, Hollaway, teaches the ability to flash a normal porch light on and off by briefly interrupting the main power at a wall switch. The main purpose, and intended use, of that invention is to alert others of an emergency within the home.

SUMMARY OF THE INVENTION

Described herein is a lamp adapter control circuit that slowly flashes the main bulb in a light fixture in response to a first interruption of power from a power switch. Also, during the off portions of the flash, it flashes an auxiliary green LED to indicate that the user wants to attract attention to his house in a non-emergency situation. A second interruption of power from the switch, quickly following the first interruption, will rapidly flash the main bulb and an auxiliary red LED to indicate that the user has an emergency.

It is practical to combine the red and green LED chips into a single LED lamp package. This also gives the impression that the LED is a single device that is simply changing colors.

DETAILED DESCRIPTION OF A PREFERRED EMBODIMENT

Figure 1:
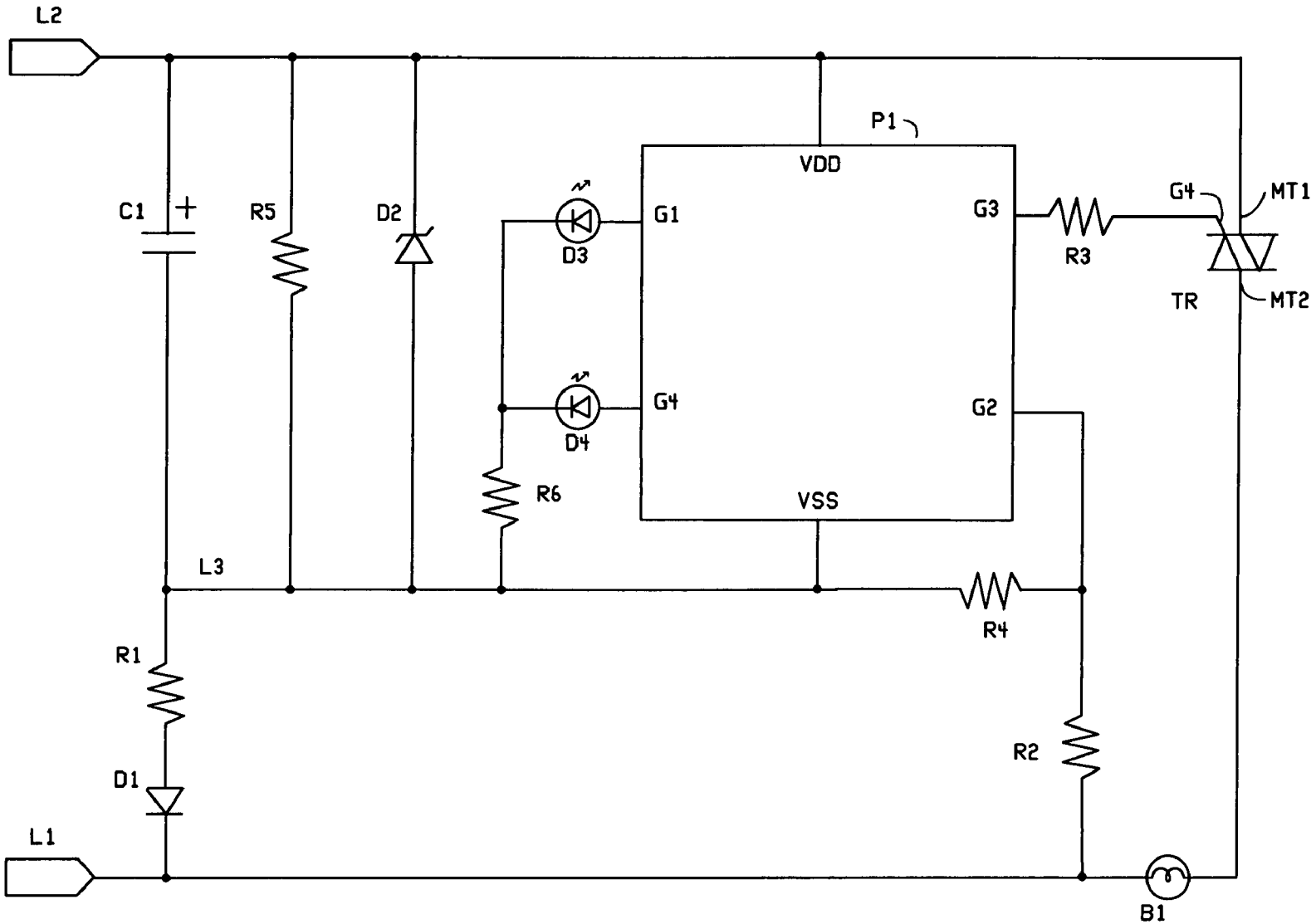
FIG. 1 is a schematic diagram of a preferred embodiment of the present invention.

Referring to FIG. 1, the AC power applied between line L1 and line L2 is converted to a lower DC voltage, using D1 as a half wave rectifier, resistor R1 as a voltage dropping element, capacitor C1 as a filter, and zener diode D2 as a voltage regulator, in an arrangement which is well known. The DC voltage, typically 5 volts, is coupled to the appropriate VDD and VSS power connections of micro-controller P1 by lines L2 and L3. Resistor R5 is connected across C1 to discharge the energy stored in C1 within a predictable time whenever the AC power across L1 and L2 is removed.

Resistor R2 is coupled between L1 and input gate G2 of P1 for the purpose of monitoring the rise and fall of the power line voltage. Resistor R4 is used to pull down G2 to zero volts during zero crossing of the AC power cycle. Each time the voltage rises at G2 a new loop through the coded instructions in P1 is started. For the purpose of time keeping, each such loop, at 60 Hz, constitutes one-sixty of a second. The coded instructions within P1 keep an internal timer running to be compared with the time that it takes to see the next voltage rise. If this time is considerable longer than one-sixty of a second, the coded instructions will declare that a power interruption has taken place.

Main terminals MT1 and MT2 of TRIAC TR are coupled between load B1 (in this case a light bulb) and power line L2. The other side of B1 is coupled directly to power line L1. The gate terminal G4 of TR is coupled to output gate G3 of P1 through resistor R3 such that a low logic level at G3 will cause power switching means TR to conduct and B1 to be energized Load D3, in this case an LED, is coupled between output gate G1 of P1 and line L3 through resistor R6 such that a high logic level at G1 will energize D3 directly.

Load D4, also an LED, is coupled between output gate G4 of P1 and line L3 through R6 such that a high logic level at G4 will energize D4 directly.

In operation, whenever the power has been off long enough for R5 to fully discharge C1, preferably about 30 seconds, logic means P1 will be initialized normally in a first mode when power is first applied. The output signals from P1 will cause B1 to be energized fully and steadily, as would be expected from any other light bulb. The output signals will cause D3 and D4 to remain de-energized. Since the full discharge of C1 is an indication that the power has been off for several minutes, it is possible for the coded instructions to apply power to B1 in a gradual manner, possibly extending bulb life.

If the AC power is now briefly interrupted, perhaps at a wall switch, the coded instructions will enter a second mode and will now change logic levels at G3 periodically, causing the light from B1 to flash on and off. Another feature of this second mode is a high logic level at G1, causing D3 to be energized.

Now, if the AC power is briefly interrupted again within a brief period of time following the first interruption, preferably about 10 seconds, the coded instructions will enter a third mode and will still change logic levels at G3 periodically, causing the light from B1 to flash on and off. In this third mode, however, a high logic level will appear at G4, causing D4 to be energized. It may be helpful for the flashing of B1 to be at different rates in different modes.

It is preferred that when the power is interrupted for a third time within a brief period of time, the control circuit will return to the first mode and return the bulb to a normal, steady light, without any light from D3 or D4.

In this preferred embodiment, light producing devices D3 and D4 are LED's that produce different colors, contained within a common package.

The logic levels at G1 and G4 may also be periodical, which will cause the lights from D3 and D4 to flash on and off. Furthermore, the coded instructions in P1 may be written such that D3 and D4 are energized during the portions of the flash that B1 is not energized.

Since the purpose of this invention is to signal neighbors, delivery personnel, visitors, and emergency services, it is important that a lamp adapter using this circuit place the red and green LED package in a position that can be seen from the street. The flashing light bulb will attract attention while the selected color will indicate the nature of the need.

Since LED packages are also available with red, green, and blue chips, additional power interruptions could be used in many different combinations of colors for many different purposes. Those skilled in the arts of electronics may find other ways of combining other circuit elements to achieve the described results within the spirit of the present invention.

I claim:

1. A light control circuit comprising:

logic means for detecting power interruptions shorter in time than a prescribed period of time and for selecting modes of operation based on the positions of said interruptions in a series of interruptions, and for providing output signals for each of said modes;

power switching means coupled between a source of power and a load, which controls the application of said power to said load in response to said output signals from said logic means; and light producing devices responsive to other of said output signals from said logic means.

2. The circuit according to claim 1, wherein said load is a light bulb.

3. The circuit according to claim 2, wherein said light bulb is caused to flash on and off in one or more of said modes.

4. The circuit according to claim 1, wherein said devices produce different colored lights.

5. The circuit according to claim 4, wherein said devices are LED's.

6. The circuit according to claim 4, wherein said output signals cause said devices to flash on and off in one or more of said modes.

7. The circuit according to claim 3, wherein said output signals only energize said devices when said light bulb is de-energized.

8. The circuit according to claim 3, wherein said flashing occurs at different rates in different of said modes.

9. The circuit of claim 2, wherein said output signals cause said power to be applied to said bulb in a gradual manner whenever said bulb has been de-energized for a relatively long period of time.

* * * * *